US010045909B2

(12) United States Patent
Greyshock et al.

(10) Patent No.: US 10,045,909 B2
(45) Date of Patent: Aug. 14, 2018

(54) STORAGE APPARATUS WITH SUPPORT STRUCTURES

(71) Applicant: Aesynt Incorporated, Cranberry, PA (US)

(72) Inventors: Shawn T. Greyshock, Tarentum, PA (US); William A. Meyer, Wexford, PA (US)

(73) Assignee: Aesynt Incorporated, Cranberry, PA (US)

( * ) Notice: Subject to any disclaimer, the term of this patent is extended or adjusted under 35 U.S.C. 154(b) by 335 days.

(21) Appl. No.: 14/053,646

(22) Filed: Oct. 15, 2013

(65) Prior Publication Data

US 2014/0034535 A1 Feb. 6, 2014

Related U.S. Application Data

(63) Continuation-in-part of application No. 13/435,010, filed on Mar. 30, 2012, now Pat. No. 8,807,389.

(51) Int. Cl.

| | |
|---|---|
| ***B65D 21/00*** | (2006.01) |
| ***B65D 85/62*** | (2006.01) |
| ***A61J 1/00*** | (2006.01) |
| ***G07F 11/00*** | (2006.01) |
| ***G07F 11/04*** | (2006.01) |
| ***G07F 11/08*** | (2006.01) |
| ***G07F 11/48*** | (2006.01) |
| ***G07F 17/00*** | (2006.01) |

(52) U.S. Cl.

CPC ..... *A61J 1/00* (2013.01); *G07F 11/007* (2013.01); *G07F 11/04* (2013.01); *G07F 11/08* (2013.01); *G07F 11/48* (2013.01); *G07F 17/0092* (2013.01)

(58) Field of Classification Search

CPC . B65D 85/62; B65D 83/04; A61J 1/00; G07F 11/007; G07F 11/04; G07F 17/0092; G07F 11/48; G07F 11/08

USPC ..... 206/528–531, 535, 538, 539, 499, 462, 206/503, 509, 511, 521, 583, 532, 735, 206/765; 220/628

See application file for complete search history.

(56) References Cited

U.S. PATENT DOCUMENTS

| | | | |
|---|---|---|---|
| 4,668,150 | A | 5/1987 | Blumberg |
| 4,717,042 | A | 1/1988 | McLaughlin |

(Continued)

FOREIGN PATENT DOCUMENTS

| | | | |
|---|---|---|---|
| WO | WO 84/03425 | A1 | 9/1984 |
| WO | WO 2007/009714 | A1 | 1/2007 |

OTHER PUBLICATIONS

International Searching Authority, International Search Report and Written Opinion for International Application No. PCT/US2013/030238, dated Jul. 18, 2013, 10 pages, European Patent Office, The Netherlands.

(Continued)

*Primary Examiner* — Rafael Ortiz

(74) *Attorney, Agent, or Firm* — Alston & Bird LLP

(57) ABSTRACT

A storage apparatus is provided. The storage apparatus defines a storage cavity having an opening at the upper surface of the storage apparatus with a substantially planar flange extending outwardly from the opening of the storage cavity and defines a plurality of support structures, each support structure (a) having an opening at the upper surface of the storage apparatus and (b) adapted to support the storage apparatus.

12 Claims, 12 Drawing Sheets

(56) References Cited

U.S. PATENT DOCUMENTS 4,785,969 A 11/1988 McLaughlin
4,847,764 A 7/1989 Halvorson
5,014,875 A 5/1991 McLaughlin et al.
5,065,897 A 11/1991 Smith
5,190,185 A 3/1993 Blechl
5,314,243 A 5/1994 McDonald et al.
5,346,297 A 9/1994 Colson, Jr. et al.
5,377,864 A 1/1995 Blechl et al.
5,405,048 A 4/1995 Rogers et al.
5,431,299 A 7/1995 Brewer et al.
5,460,294 A 10/1995 Williams
5,468,110 A 11/1995 McDonald et al.
5,480,062 A 1/1996 Rogers et al.
5,520,450 A 5/1996 Colson, Jr. et al.
5,564,803 A 10/1996 McDonald et al.
5,593,267 A 1/1997 McDonald et al.
5,661,978 A 9/1997 Holmes et al.
D384,578 S 10/1997 Wangu et al.
5,713,485 A 2/1998 Liff et al.
5,716,114 A 2/1998 Holmes et al.
5,745,366 A 4/1998 Higham et al.
5,761,877 A 6/1998 Quandt
5,797,515 A 8/1998 Liff et al.
5,805,456 A 9/1998 Higham et al.
5,842,976 A 12/1998 Williamson
5,878,885 A 3/1999 Wangu et al.
5,880,443 A 3/1999 McDonald et al.
5,883,806 A 3/1999 Meador et al.
5,893,697 A 4/1999 Zini et al.
5,894,930 A * 4/1999 Faughey ..... B65D 75/327 206/469
5,905,653 A 5/1999 Higham et al.
5,912,818 A 6/1999 McGrady et al.
5,927,540 A 7/1999 Godlewski
5,940,306 A 8/1999 Gardner et al.
5,971,593 A 10/1999 McGrady
6,003,006 A 12/1999 Colella et al.
6,011,999 A 1/2000 Holmes
6,021,392 A 2/2000 Lester et al.
6,039,467 A 3/2000 Holmes
6,065,819 A 5/2000 Holmes et al.
6,068,156 A 5/2000 Liff et al.
6,109,774 A 8/2000 Holmes et al.
6,112,502 A 9/2000 Frederick et al.
6,116,461 A 9/2000 Broadfield et al.
6,151,536 A 11/2000 Arnold et al.
6,170,230 B1 1/2001 Chudy et al.
6,176,392 B1 1/2001 William et al.
6,189,727 B1 2/2001 Shoenfeld
6,223,934 B1 5/2001 Shoenfeld
6,256,967 B1 7/2001 Hebron et al.
6,283,322 B1 9/2001 Liff et al.
6,289,656 B1 9/2001 Wangu et al.
6,338,007 B1 1/2002 Broadfield et al.
6,339,732 B1 1/2002 Phoon et al.
6,345,717 B1 * 2/2002 Flewitt ..... B65D 75/327 206/531
6,361,263 B1 3/2002 Dewey et al.
6,370,841 B1 4/2002 Chudy et al.
6,415,952 B1 7/2002 Ohtuka et al.
6,449,927 B2 9/2002 Hebron et al.
6,471,089 B2 10/2002 Liff et al.
6,497,342 B2 12/2002 Zhang et al.
6,499,270 B2 12/2002 Peroni et al.
6,532,399 B2 3/2003 Mase
6,564,121 B1 5/2003 Wallace et al.
6,581,798 B2 6/2003 Liff et al.
6,609,047 B1 8/2003 Lipps
6,611,733 B1 8/2003 De La Huerga
6,625,952 B1 9/2003 Chudy et al.
6,640,159 B2 10/2003 Holmes et al.
6,650,964 B2 11/2003 Spano, Jr. et al.
6,671,579 B2 12/2003 Spano, Jr. et al.
6,681,149 B2 1/2004 William et al.
6,682,289 B1 1/2004 Credle, Jr.
6,742,671 B2 6/2004 Hebron et al.
6,755,931 B2 6/2004 Vollm et al.
6,760,643 B2 7/2004 Lipps
6,776,304 B2 8/2004 Liff et al.
6,785,589 B2 8/2004 Eggenberger et al.
6,790,198 B1 9/2004 White et al.
6,814,254 B2 11/2004 Liff et al.
6,814,255 B2 11/2004 Liff et al.
6,847,861 B2 1/2005 Lunak et al.
6,874,684 B1 4/2005 Denenberg et al.
6,892,780 B2 5/2005 Vollm et al.
6,895,304 B2 5/2005 Spano, Jr. et al.
6,975,922 B2 12/2005 Duncan et al.
6,985,797 B2 1/2006 Spano, Jr. et al.
6,996,455 B2 2/2006 Eggenberger et al.
7,010,389 B2 3/2006 Lunak et al.
7,014,063 B2 3/2006 Shows et al.
7,016,766 B2 3/2006 William et al.
7,040,504 B2 5/2006 Broadfield et al.
7,052,097 B2 5/2006 Meek, Jr. et al.
7,072,737 B2 7/2006 Lunak et al.
7,072,855 B1 7/2006 Godlewski et al.
7,077,286 B2 7/2006 Shows et al.
7,085,621 B2 8/2006 Spano, Jr. et al.
7,092,796 B2 8/2006 Vanderveen
7,093,755 B2 8/2006 Jordan et al.
7,100,792 B2 9/2006 Hunter et al.
7,103,419 B2 9/2006 Engleson et al.
7,111,780 B2 9/2006 Broussard et al.
7,139,639 B2 11/2006 Broussard et al.
7,150,724 B2 12/2006 Morris et al.
7,171,277 B2 1/2007 Engleson et al.
7,218,231 B2 5/2007 Higham
7,228,198 B2 6/2007 Vollm et al.
7,249,688 B2 7/2007 Hunter et al.
7,348,884 B2 3/2008 Higham
7,417,729 B2 8/2008 Greenwald
7,419,133 B2 9/2008 Clarke et al.
7,426,425 B2 9/2008 Meek, Jr. et al.
7,554,449 B2 6/2009 Higham
7,571,024 B2 8/2009 Duncan et al.
7,588,167 B2 9/2009 Hunter et al.
8,251,254 B2 8/2012 Guggenmos et al.
2003/0136698 A1 * 7/2003 Klatt ..... A61J 1/035 206/499
2005/0098469 A1 * 5/2005 Agakanian ..... B65D 21/0204 206/503
2006/0027480 A1 * 2/2006 Buss ..... B65D 75/327 206/532
2011/0114532 A1 * 5/2011 Francois ..... A61K 9/006 206/528
2012/0305584 A1 * 12/2012 Carson ..... A61J 1/03 221/1

OTHER PUBLICATIONS

United States Patent and Trademark Office, Office Action for U.S. Appl. No. 13/435,010, dated Feb. 6, 2014, 12 pages, USA.
United States Patent and Trademark Office, Notice of Allowance for U.S. Appl. No. 13/435,010, dated May 13, 2014, 7 pages, USA.

* cited by examiner

STORAGE APPARATUS WITH SUPPORT STRUCTURES

CROSS-REFERENCE TO RELATED APPLICATIONS

This application is a continuation-in-part of U.S. application Ser. No. 13/435,010 filed Mar. 30, 2012, which is hereby incorporated herein in its entirety by reference.

BACKGROUND

Various sizes and dimensions of storage apparatus exist for storing items, such as medications. A need exists to provide for standard sizes and dimensions of storage apparatus that can store different sizes, quantities, and shapes of items.

BRIEF SUMMARY

In accordance with one aspect, a storage apparatus is provided. The storage apparatus may (1) comprise an upper surface and a lower surface, (2) define a storage cavity having an opening at the upper surface of the storage apparatus with a substantially planar flange extending outwardly from the opening of the storage cavity; and (3) define a plurality of support structures, each support structure (a) having an opening at the upper surface of the storage apparatus and (b) adapted to support the storage apparatus.

In accordance with another aspect, a stack of storage apparatus is provided. Each storage apparatus in the stack (1) comprises an upper surface and a lower surface; (2) defines a storage cavity having an opening at the upper surface of the storage apparatus with a substantially planar flange extending outwardly from the opening of the storage cavity; and (3) defines a plurality of support structures, each support structure (a) having an opening at the upper surface of the storage apparatus and (b) adapted to support the storage apparatus.

BRIEF DESCRIPTION OF THE SEVERAL VIEWS OF THE DRAWING(S)

Reference will now be made to the accompanying drawings, which are not necessarily drawn to scale, and wherein.

FIGS. 3A, 3B, 3C, 3D, 3E, 3F, and 3G illustrate different perspectives of a blister package according to one embodiment of the present invention.

FIGS. 4A, 4B, 4C, 4D, 4E, and 4F illustrate different perspectives of a storage apparatus according to one embodiment of the present invention.

FIGS. 5-8 illustrate different perspective views of a magazine according to one embodiment of the present invention.

Figure 9:
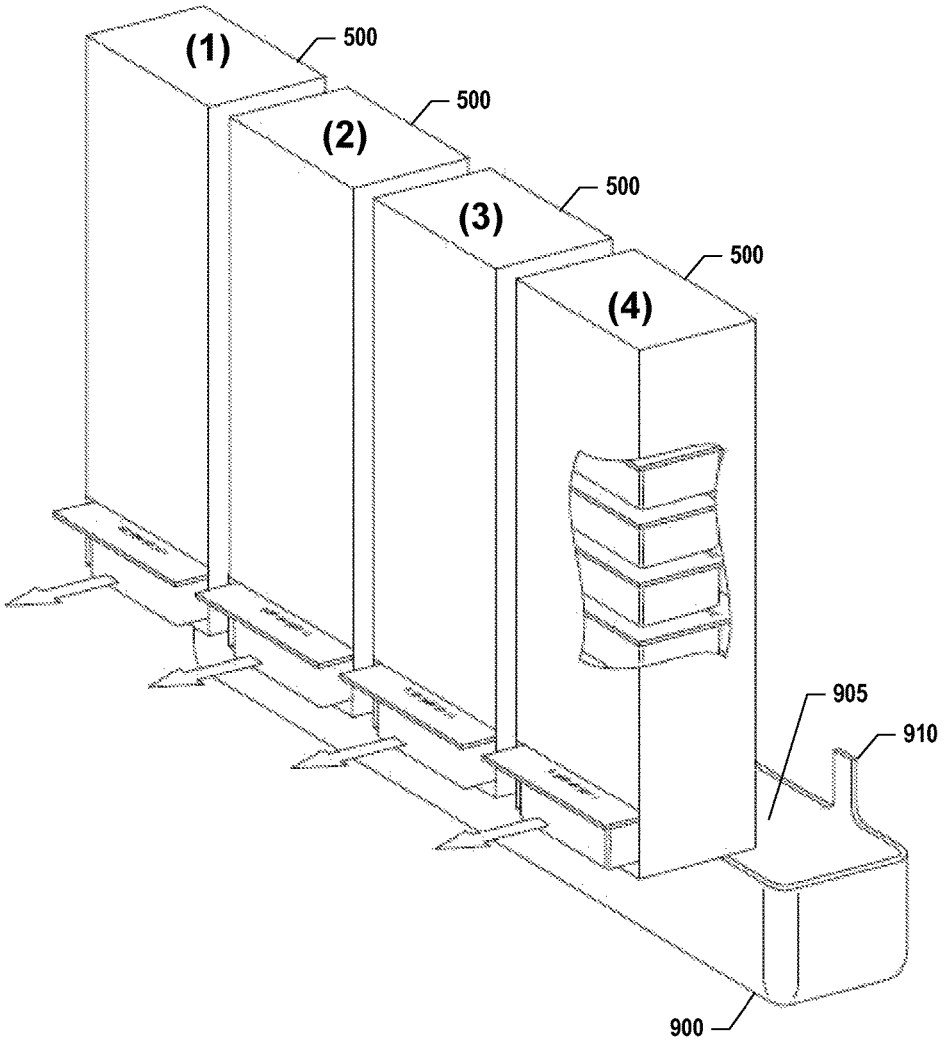
Figure 10:
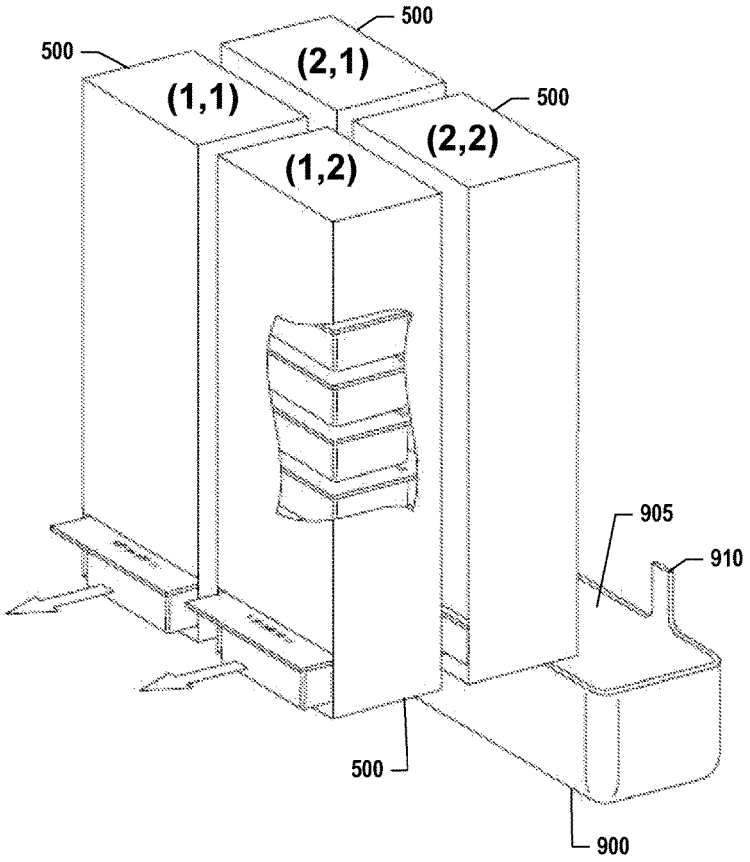

FIGS. 9 and 10 illustrate a plurality of magazines and receptacles according to one embodiment of the present invention.

Figure 11:
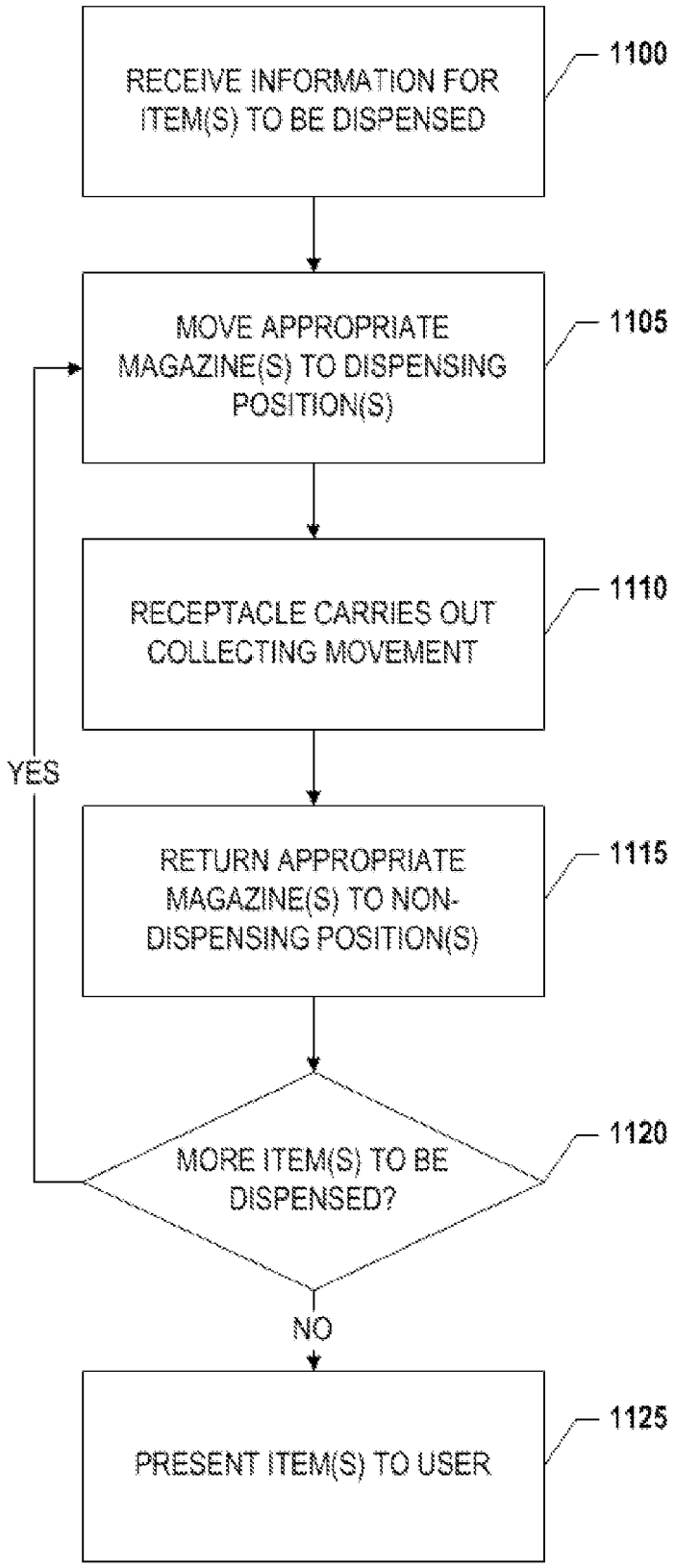

FIG. 11 is a flowchart illustrating operations and processes that can be used in accordance with various embodiments of the present invention.

DETAILED DESCRIPTION

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

I. Computer Program Products, Methods, and Computing Entities

Embodiments of the present invention may be implemented in various ways, including as computer program products. A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, program code, and/or similar terms). Such non-transitory computer-readable storage media includes all computer-readable media (including volatile and non-volatile media), with the sole exception being a transitory, propagating signal.

In one embodiment, a non-volatile computer-readable storage medium may include a floppy disk, flexible disk, hard disk, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory, multimedia memory cards (MMC), secure digital (SD) memory cards, Memory Sticks, and/or the like. Further, a non-volatile computer-readable storage medium may also include conductive-bridging random access memory (CBRAM), phase-change random access memory (PRAM), ferroelectric random-access memory (FeRAM), resistive random-access memory (RRAM), Silicon-Oxide-Nitride-Oxide-Silicon memory (SONOS), racetrack memory, and/or the like.

In one embodiment, a non-volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Rambus in-line memory module (RIMM), dual in-line memory module (DIMM), single in-line memory module (SIMM), video random access memory (VRAM), cache memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments of the present invention may also be implemented as methods, apparatus, systems, computing devices, computing entities, and/or the like. As such, embodiments of the present invention may take the form of an apparatus, system, computing device, computing entity, and/or the like executing instructions stored on a computer-readable storage medium to perform certain steps or operations. However, embodiments of the present invention may also take the form of an entirely hardware embodiment performing certain steps or operations.

Embodiments of the present invention are described below with reference to block diagrams and flowchart illustrations. Thus, it should be understood that each block of the block diagrams and flowchart illustrations may be implemented in the form of a computer-readable storage medium, an entirely hardware embodiment, a combination of hardware and computer program products, and/or apparatus, systems, computing devices, computing entities, and/or the like carrying out instructions on a computer-readable storage medium for execution. Such embodiments can produce specifically-configured machines performing the steps or operations specified in the block diagrams and flowchart illustrations. Accordingly, the block diagrams and flowchart illustrations support various combinations of embodiments for performing the specified steps or operations.

II. Exemplary Dispensing Unit

Figure 1:
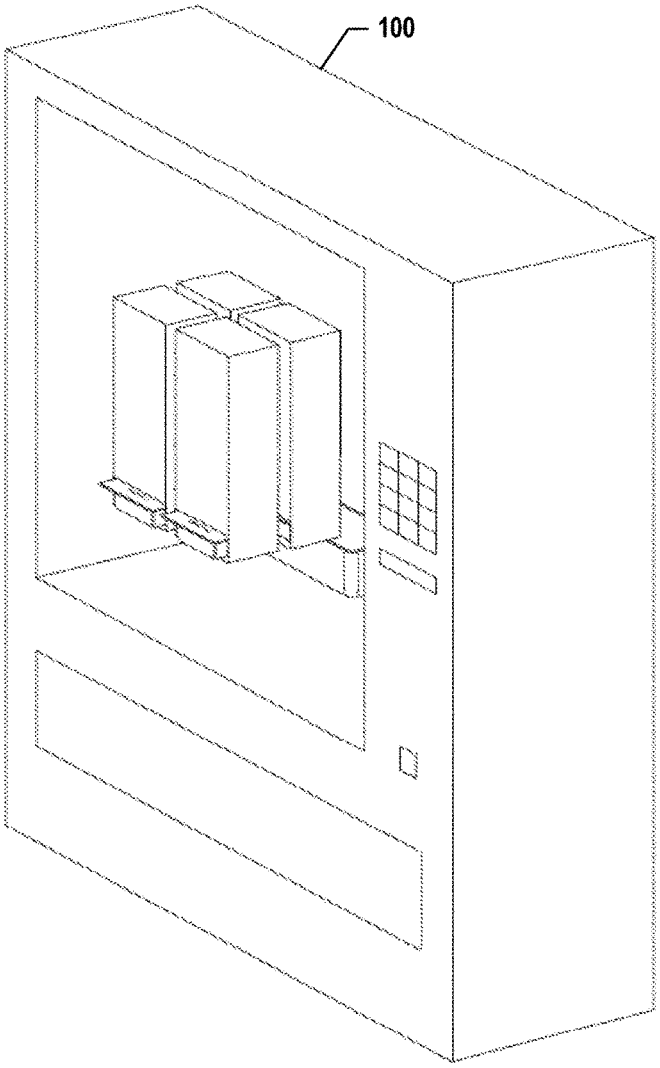
FIG. 1 is an overview of a dispensing unit according to one embodiment of the present invention.

FIG. 1 provides an illustration of an exemplary dispensing unit 100 according to one embodiment of the present invention. A dispensing unit 100 can be used to hold, store, or house (and similar terms used herein interchangeably) various items for dispensing and presentation of the same. Such items may include storage apparatuses (e.g., blister packages) that are described in greater detail below. However, it should be noted that although embodiments of the present invention are described below with regard to dispensing blister packages, embodiments of the present invention may be applied to most any environment for dispensing items that are capable of being stacked, stored, or otherwise housed in a substantially uniform manner. As will be described, the dispensing unit 100 may include a variety of components and features for performing or enabling the performance of the functions described herein.

1. Exemplary Dispensing Unit Computing Entity

Figure 2:
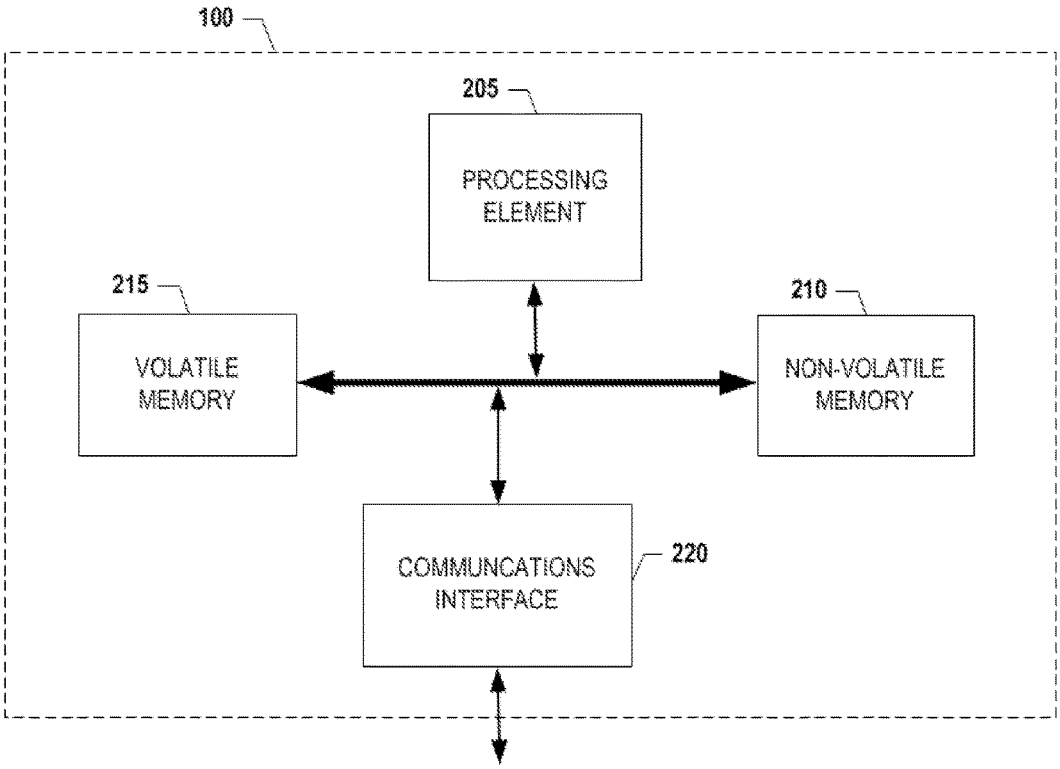
FIG. 2 is an exemplary schematic diagram of a dispensing unit computing entity according to one embodiment of the present invention.

In one embodiment, the dispensing unit 100 comprises a dispensing unit computing entity. FIG. 2 provides a schematic of a dispensing unit computing entity according to one embodiment of the present invention. In one embodiment, the dispensing unit computing entity can be used to control various aspects of the dispensing unit 100. For example, the dispensing unity computing entity can control movement of the magazines 500 and the receptacles 900, monitor and communicate inventory levels, and control presentation of items being dispensed. As will be recognized, the term computing entity may refer to, for example, one or more computers, computing devices, computing entities, mobile phones, desktops, tablets, notebooks, laptops, distributed systems, servers, proxies, blades, gateways, switches, processing devices, processing entities, relays, routers, network access points, base stations, the like, and/or any combination of devices or entities adapted to perform the functions described herein. As shown in FIG. 2, in one embodiment, the dispensing unit computing entity may include or be in communication with one or more processing elements 205 (also referred to as processors, processing circuitry, and/or similar terms used herein interchangeably) that communicate with other elements within the dispensing unit computing entity via a bus, for example. As will be understood, the processing element 205 may be embodied in a number of different ways. For example, the processing element 205 may be embodied as one or more complex programmable logic devices (CPLDs), microprocessors, multi-core processors, coprocessing entities, application-specific instruction-set processors (ASIPs), and/or controllers. Further, the processing element 205 may be embodied as one or more other processing devices or circuitry. The term circuitry may refer to an entirely hardware embodiment or a combination of hardware and computer program products. Thus, the processing element 205 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 205 may be configured for a particular use or configured to execute instructions stored in volatile or non-volatile media or otherwise accessible to the processing element 205. As such, whether configured by hardware or computer program products, or by a combination thereof, the processing element 205 may be capable of performing steps or operations according to embodiments of the present invention when configured accordingly.

In one embodiment, the dispensing unit computing entity may further include or be in communication with non-volatile media (also referred to as non-volatile storage, memory, memory storage, memory circuitry and/or similar terms used herein interchangeably). In one embodiment, the non-volatile storage or memory may include one or more non-volatile storage or memory media 210 as described above, such as hard disks, ROM, PROM, EPROM, EEPROM, flash memory, MMCs, SD memory cards, Memory Sticks, CBRAM, PRAM, FeRAM, RRAM, SONOS, racetrack memory, and/or the like. As will be recognized, the non-volatile storage or memory media may store databases, data, applications, programs, program modules, scripts, source code, object code, byte code, compiled code, interpreted code, machine code, executable instructions, and/or the like.

In one embodiment, the dispensing unit computing entity may further include or be in communication with volatile media (also referred to as volatile storage, memory, memory storage, memory circuitry and/or similar terms used herein interchangeably). In one embodiment, the volatile storage or memory may also include one or more volatile storage or memory media 215 as described above, such as RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. As will be recognized, the volatile storage or memory media may be used to store at least portions of the databases, data, applications, programs, program modules, scripts, source code, object code, byte code, compiled code, interpreted code, machine code, executable instructions, and/or the like being executed by, for example, the processing element 205. Thus, the databases, data, applications, programs, program modules, scripts, source code, object code, byte code, compiled code, interpreted code, machine code, executable instructions, and/or the like may be used to control certain aspects of the operation of the dispensing unit computing entity with the assistance of the processing element 205 and operating system. For example, as described above, the dispensing unit computing entity can be used to control certain aspects of the dispensing unit 100, such as controlling movement of the magazines 500 and the receptacles 900, monitoring and communicating inventory levels, and controlling presentation of items being dispensed.

As indicated, in one embodiment, the dispensing unit computing entity may also include one or more communications interfaces 220 for communicating with various computing entities, such as by communicating data, content, information, and/or similar terms used herein interchangeably that can be transmitted, received, operated on, processed, displayed, stored, and/or the like. Such direct or indirect communication may be via the same or different wired or wireless networks (or a combination of wired and wireless networks). For instance, the communication may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, the dispensing unit computing entity may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000 1X (1xRTT), Wideband Code Division Multiple Access (WCDMA), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), 802.16 (WiMAX), ultra wideband (UWB), infrared (IR) protocols, Bluetooth™ protocols, wireless universal serial bus (USB) protocols, and/or any other wireless protocol.

Although not shown, the dispensing unit computing entity may include or be in communication with one or more input elements, such as a keyboard input, a mouse input, a touch screen/display input, audio input, pointing device input, joystick input, keypad input, and/or the like. The dispensing unit computing entity may also include or be in communication with one or more output elements (not shown), such as audio output, video output, screen/display output, motion output, movement output, and/or the like.

As will be appreciated, one or more of the dispensing unit computing entity's components may be located remotely from other dispensing unit computing entity components. Furthermore, one or more of the components may be combined and additional components performing functions described herein may be included in the dispensing unit computing entity. Thus, the dispensing unit computing entity can be adapted to accommodate a variety of needs and circumstances for dispensing and presenting items, such as blister packages.

2. Exemplary Storage Apparatus

In one embodiment, a storage apparatus may be used with embodiments of the present invention. In a particular embodiment, the storage apparatus may be a blister package, such as those shown in FIGS. 3A, 3B, 3C, 3D, 3E, 3F, 3G, 4A, 4B, 4C, 4D, 4E, and 4F. As will be described in greater detail, the blister packages may be adapted and sized to store medications (or other items) of different shapes and sizes.

In one embodiment, the blister package may be made of a variety of flexible or rigid materials, such as polyvinyl chloride (PVC), polychlorotrifluoroethylene (PCTFE), cyclic olefin copolymers (COC) or polymers (COP), polyethylene terephthalate (PETG), Nylon/Surlyn®, foil, paper, and/or the like. The blister package may also be formed using a variety of techniques, such as thermoforming, cold forming, and/or the like. Once appropriately formed, the blister packages may comprise or define an upper surface 310, a lower surface 315, one or more medication cavities 305, and one or more support structures 300.

Figure 3A:
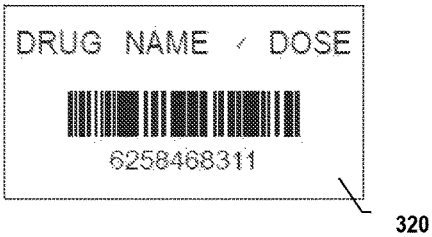
Figure 3B:
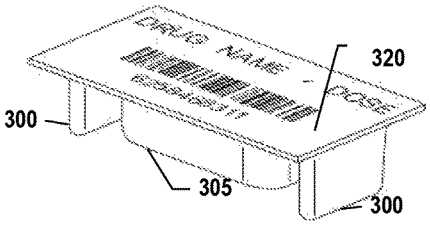
Figure 3C:
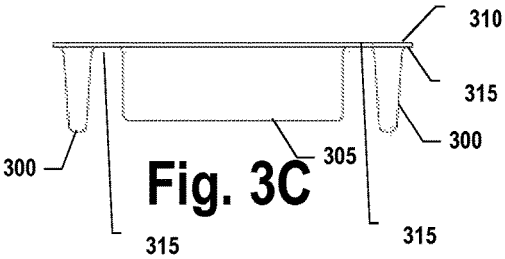
Figure 3D:
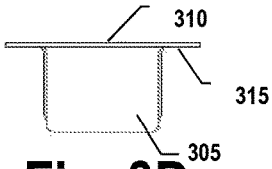
Figure 3E:
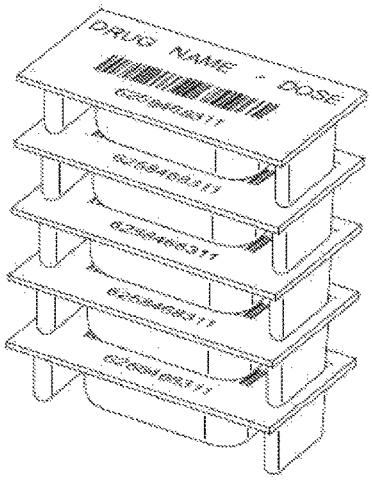
Figure 3F:
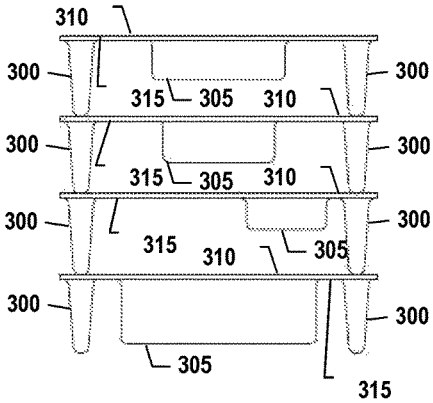
Figure 3G:
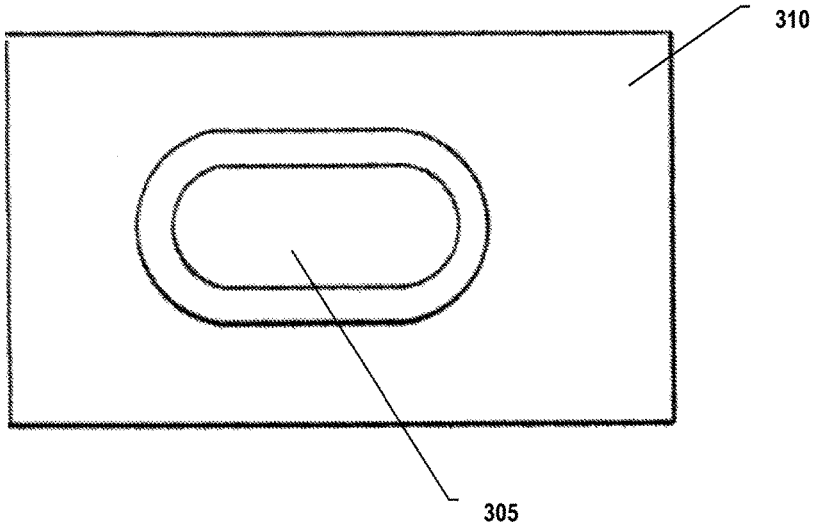
Figure 4A:
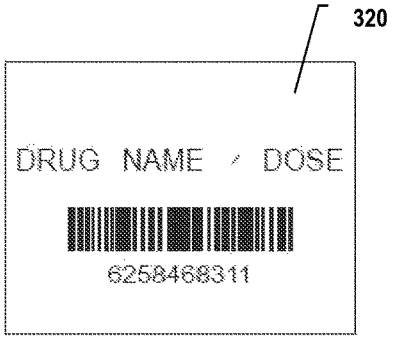
Figure 4B:
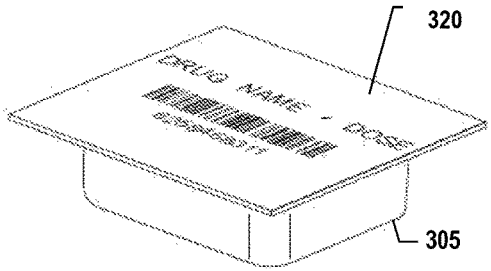
Figure 4C:
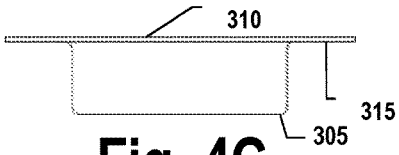
Figure 4D:
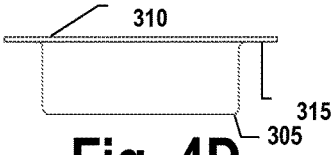
Figure 4E:
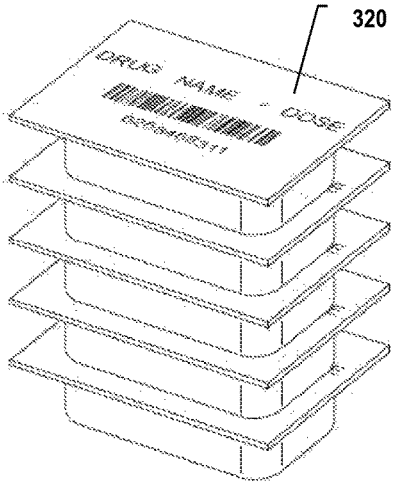
Figure 4F:
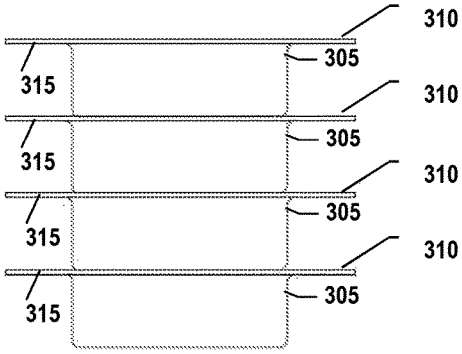
Figure 5:
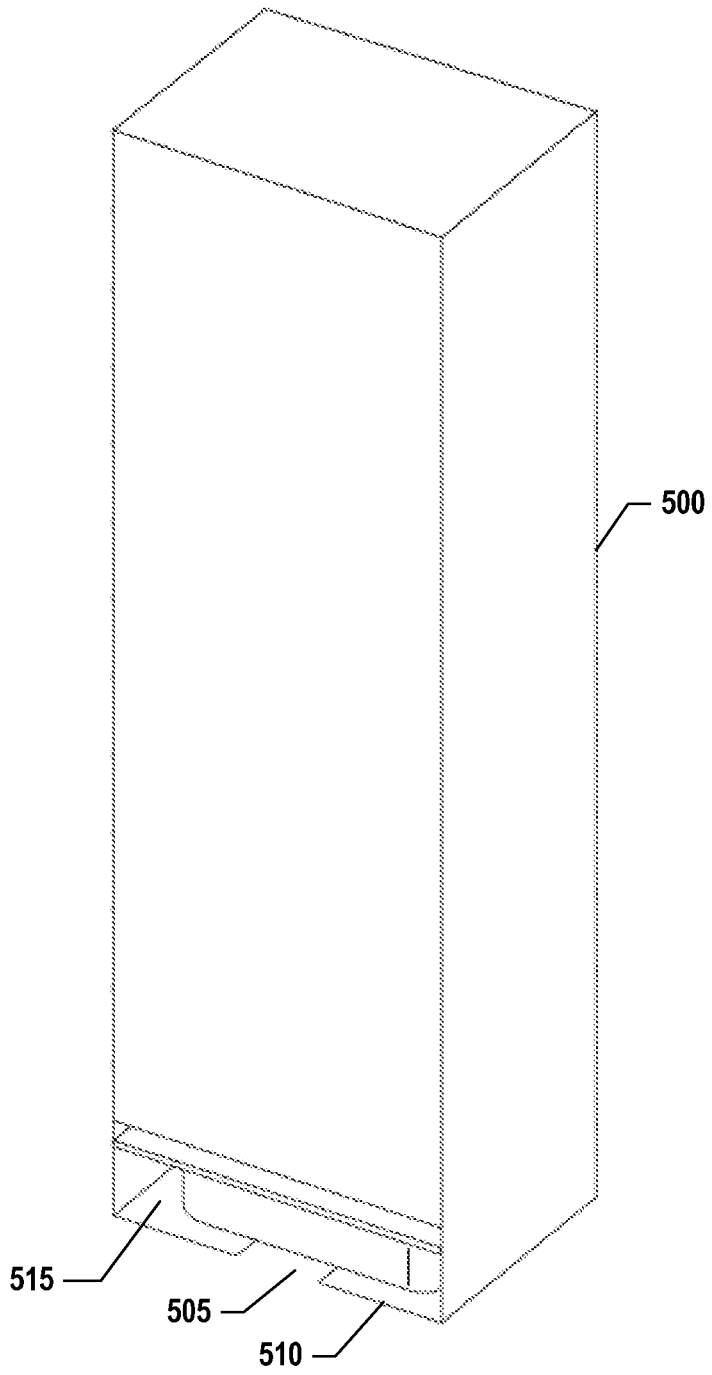

As shown in FIG. 3G, such medication cavities 305 may define or have openings at the upper surface 310 of the blister package, with the upper surface 310 creating a substantially planar flange extending outwardly from the opening of the medication cavity 305 (see FIG. 3G)—for embodiments not related to the medication context, this may be a storage cavity 305. In one embodiment, the medication cavity 305 may be defined to store medications (or other items) of different shapes and sizes. For example, a medication cavity 305 can be individually sized to accept a specific type, size, quantity, and/or dosage of medication. Further, a medication cavity 305 can also be sized to accept multiple medications of a specific type, size, quantity, and/or dosage with the blister package being of substantially standard dimensions. In another embodiment, a blister package may define multiple medication cavities 305 (not shown) each sized to (a) accept a specific type, size, quantity, and/or dosage of medication while the blister package itself is of substantially standard dimensions and/or (b) accept multiple medications of a specific type, size, quantity, and/or dosage with the blister package being of substantially standard dimensions. As can be seen in FIG. 3F, the medication cavities 305 can be centered or offset from the center to allow for multiple medication cavities 305 to be defined from the upper surface 310 of the blister package, to allow for proper storage in a magazine 500, to allow for consistent or proper removal from a magazine 500 by a rake element extending from a receptacle 900, and/or the like.

In one embodiment, in addition to defining one or more medication cavities 305, the blister package may define one or more cavities as support structures 300 (or support cavities 300). The cavities of the support structures 300 may define or have openings at the upper surface 310 of the blister package, with the upper surface 310 comprising or creating a substantially planar flange extending outwardly from the openings of the support structures 300 of the blister package (similar to the medication cavity 305). In this particular embodiment, the support structures (or support cavities 300 in this embodiment) may be cavities extending beyond the medication cavity 305 in a direction away from the opening of the medication cavity 305. Thus, similar to the medication cavity 305, the interior of each support structure 300 may be hollow and open proximate the upper surface 310 of the blister package. This configuration may allow for the support structures 300 to be formed in the same or a similar manner as the medication cavity 305 for efficient production. Further, openings of the support structures 300 proximate the upper surface 310 of the blister package may be sized in a sufficiently narrow manner such that medications cannot inadvertently fall into the cavities of the support structures 300 (e.g., via flood feeding). For instance, embodiments of the present invention can comply with existing flood feeding packaging devices. In flood feeding, a preformed shape that is slightly larger than one pill can be created. The shape travels under a bulk supply of like medications. Due to the size of the cavity, only one pill is able to fall in the cavity. Extremely high feed rates can be achieved with this process versus manually placing a single medication into a universally sized medication cavity. With the openings of the support structures 300 being sized in a sufficiently narrow manner such that medications cannot inadvertently fall into the cavities of the support structures 300, existing flood feed techniques can be used with the support structures 300.

As shown in the figures, the support structures 300 (e.g., defined support cavities 300) may be defined on opposite sides of the medication cavity 305 proximate the edges and defined to extend beyond the medication cavity 305 in a direction away from the opening of the medication cavity 305. In the embodiment shown in FIGS. 3B-3F, there are two support structures or cavities 300—each with a substantially rectangular cross section having a fixed length, width, and height (extending beyond the medication cavity 305 in a direction away from the opening of the storage cavity). In another embodiment, there may be four support structures 300, each with a substantially spherical or rectangular cross section located proximate each corner of the blister package and extending beyond the medication cavity 305 in a direction away from the opening of the storage cavity (not shown). As will be recognized, the number of support structures 300, the shapes of their cross sections, and their locations on the blister package may vary to adapt to a variety of needs and circumstances.

In these embodiments, the number, shapes, and locations/positions of the support structures 300 are adapted such that the weight of the blister package can be supported thereby in a stable manner (see FIGS. 3B, 3C, 3D, 3E, and 3F). Further, in one embodiment, when the backing 320 is sealed to a flange of an upper surface 310 of a blister package, multiple blister packages can be stacked, stored, housed, and/or similar words used herein interchangeably in a substantially uniform manner (one on top of another as shown in FIGS. 3B, 3C, 3D, 3E, 3F, 7, and 8). This may be true regardless of whether each blister package is storing the same type or quantity of medication, whether the medication cavities 305 are the same size or in the same position (see FIG. 3F), and/or the like. In other words, the substantially uniform support structures 300 allow the blister packages (with potentially varying medication cavity 305 sizes and shapes) to be stacked on one another (or be held in a similar configuration). Further, such a configuration allows for a stack of blister packages to be maintained at a consistent height and contained in a repeatable or uniform manner (with the substantially planar flanges extending outwardly from each support structure being substantially parallel to the upper surface 310 of each other blister package). Thus, as previously noted and shown in FIG. 3F, even though the size and shape of the medication cavities 305 may vary, the overall stacked height and form of the blister packages remains the same.

As noted, the upper surface 310 may comprise or create a substantially planar flange extending outwardly from the opening of (a) each medication cavity 305 (see FIG. 3G) and (b) each support structure 300 (not shown but similar to FIG. 3G). FIG. 3G shows the upper surface 310 creating or comprising a substantially planar flange extending outwardly from the opening of the medication cavity 305. The substantially planar flange may allow for an adhesive to be applied to all or a portion of the flange extending outwardly (a) from the opening of each medication cavity 305 and/or (b) from the openings of the support structures 300 to create a bond between the blister package and a backing 320 (with a medication or other item stored in the interior of the medication cavity 305 and enclosed by the backing 320). As will be recognized, the adhesive can be applied only around the flange extending outwardly from the opening of the medication cavity 305, only around the flange extending outwardly from the openings of the support structures 300, around both the flange extending outwardly from the opening of the medication cavity 305 and the flange extending outwardly from the openings of the support structures 300, and/or the like. Thus, the width or depth of the flange extending from the opening of the medication cavity 305, the thickness of the material of the blister package, and the seal may determine how long the medication (or other items) can be safely stored in the blister package. The width or depth of the flange and the amount and type of adhesive can vary to adapt to different needs and circumstances. For instance, the substantially planar flange may extend outwardly from the medication cavity 305 to meet various standardized packaging or medication guidelines or requirements.

In one embodiment, a backing 320 may be adhered, sealed, and/or similar words used herein interchangeably to the flanges to seal the blister package. The backing 320 may be made of foil, paper, plastics, and/or the like. The backing 320 may provide a substantially flat upper surface such that information can be printed or disposed thereon. Such information printed or disposed thereon may include an identification code (e.g., barcode, radio frequency identification (RFID) tag), text, a combination of alphanumeric characters, symbols, and/or the like. Such information may be associated with the dosage, expiration, manufacturer, lot, and/or the like of the medication stored in the blister package.

Further, as will be described in greater detail below, the blister packages may conform to standard dimensions to allow blister packages storing medications of different types, dosages, shapes, sizes, and/or the like to be stacked, stored, and dispensed in a common magazine. That is, the standard dimensions for blister packages can be used for storing all medications regardless of their shape or size. This may allow for a standard dimensioned magazine 500 to be used for dispensing all medications. To that end, as shown in FIGS. 3A, 3B, 3C, 3D, 3E, 3F, and 3G, blister packages may be of a substantially uniform length, uniform width, and uniform height to allow for all blister packages to be stacked, stored, and dispensed in a uniform magazine 500.

In another embodiment, the blister package may not define or comprise support structures, but may be supported by the medication cavity 305. In this embodiment, the blister packages may have a medication cavity 305 that conforms to one of many standard dimensions. Such a medication cavity 305 may be adapted to accommodate various types, sizes, quantities, and dosages of medications. For example, as shown in FIGS. 4A, 4B, 4C, 4D, 4E, and 4F, the medication cavity 305 may be sufficiently sized and shaped to store various types of medications—regardless of the sizes and shapes of the medications. Thus, because the medication cavity 305 is of a standard size and shape and the blister packages have substantially flat upper surfaces, the blister packages may be stacked on one another (or be held in a similar configuration). Further, a stack of such blister packages can be maintained at a consistent height and contained in a repeatable or uniform manner.

3. Exemplary Magazines

In one embodiment, the dispensing unit may comprise one or more magazines 500 that conform to one of many standard dimensions based on, for example, the blister packages they are designed to store. For example, as shown in FIGS. 5-8, a magazine 500 may comprise a front, a back, sides, a top, and a bottom. In one embodiment, the interior of the front, back, and sides of the magazine 500 may define a channel that is sized to accept one or more blister packages, such as those described above. As shown in FIGS. 5-8, this configuration allows any number of blister packages to be accepted and stored in a stacked arrangement. For example, in one embodiment, a magazine 500 may be sized to accept and store blister packages that are one inch in height, two inches in width, and four inches in length. In another embodiment, a magazine 500 may be sized to accept and store blister packages that are two inches in height, four inches in width, and six inches in length. Magazines 500 of different dimensions can be used with a single dispensing unit 100 to dispense different sizes of blister packages (or other items or packaging).

Additionally, in one embodiment, the front of the magazine 500 may define a dispensing opening 510 proximate the bottom and sliding surface 515 of the magazine 500. As shown in FIGS. 9 and 10, the dispensing opening 510 allows for blister packages to be urged on the sliding surface 515 toward the front of the magazine 500 and out of the dispensing opening 510. As will be recognized, the dispensing opening 510 can be sized to allow one blister package to be urged from the dispensing opening 510 at a time. Accordingly, the remaining blister packages remain in the channel of the magazine 500 when the blister package in contact with the sliding surface 515 of the bottom is urged out of the dispensing opening 510.

Figure 6:
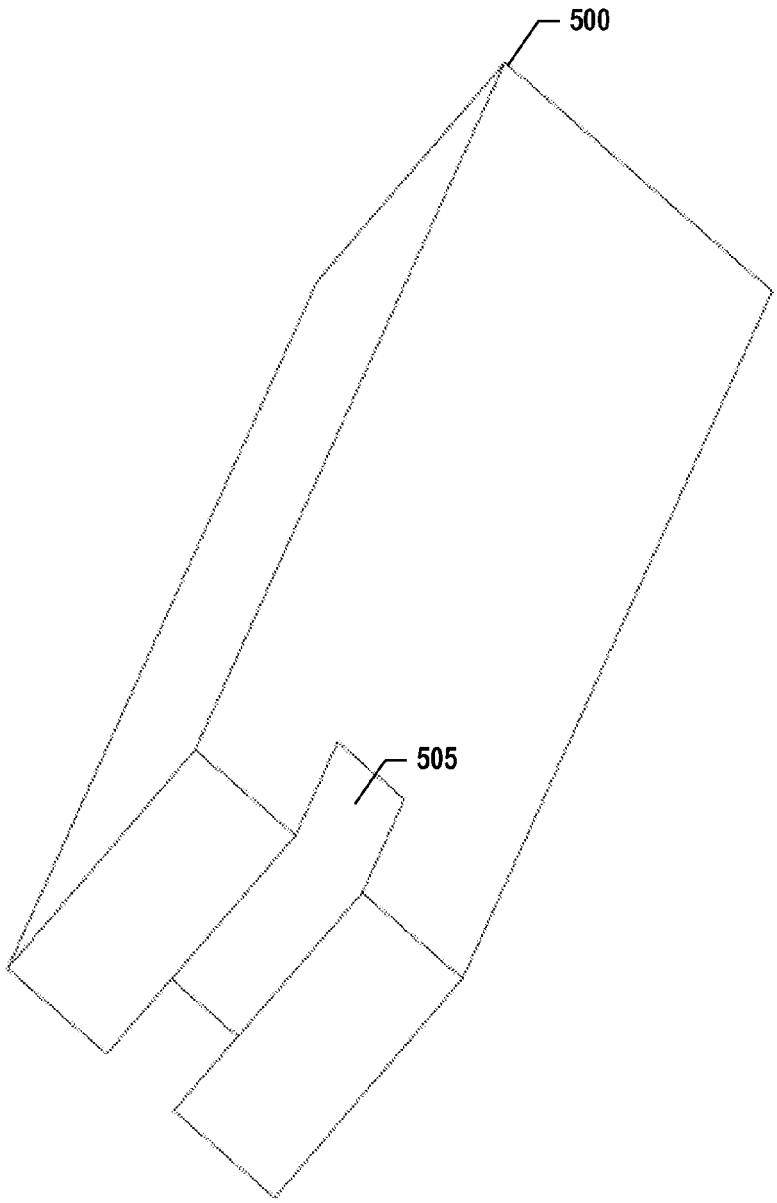
Figure 7:
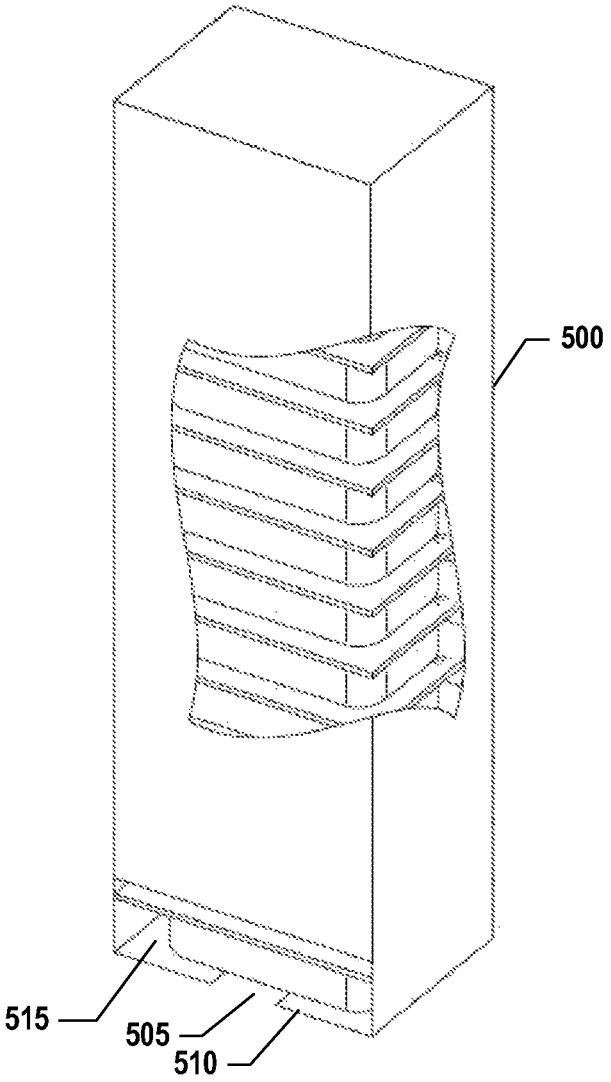

In addition to the dispensing opening 510, in one embodiment, the magazine 500 can define a rake element path 505. As shown in FIG. 6, the rake element path 505 can be defined from the bottom of the back of the magazine 500 through the front of the dispensing opening 510. The rake element path 505 can be sized and shaped to allow for a rake element 910 to pass through the rake element path 505 to engage a blister package (e.g., e.g., the support structures 30, the medication cavities 305, and/or the like providing consistent contact points) in contact with the sliding surface 515 of the bottom to urge the blister package out of the dispensing opening 510.

In one embodiment, the magazine 500 may be secured, attached, mounted, and similar terms used herein interchangeably to a frame within the dispensing unit 100 (not shown) for selective movement of the magazine 500. The selective movement may allow the magazine 500 to be selectively moved from a non-dispensing position to a dispensing position and back (e.g., via the dispensing unit computing entity). In a particular embodiment, the magazine 500 can be secured or attached to a frame in a vertical position with respect to the top and bottom of the magazine 500. This may allow the magazine 500 to be selectively lowered from its non-dispensing position within the dispensing unit 100 to a dispensing position. Further, because the magazines 500 may be of different dimensions, each magazine 500 may need to be lowered a unique distance to its dispensing position. For example, a magazine 500 storing blister packages that are one inch in height, two inches in width, and four inches in length may need to be lowered four inches to be in dispensing position. Similarly, a magazine 500 storing blister packages that are two inches in height, four inches in width, and six inches in length may need to be lowered three inches to be in dispensing position. Once in dispensing position, a blister package in contact with the sliding surface 515 of the bottom can be urged out of the dispensing opening 510 and gravity can urge the remaining blister packages toward the bottom of the magazine 500. After dispensing a blister package, the magazine can be raised to its non-dispensing position within the dispensing unit 100 (e.g., via the dispensing unit computing entity).

Figure 8:
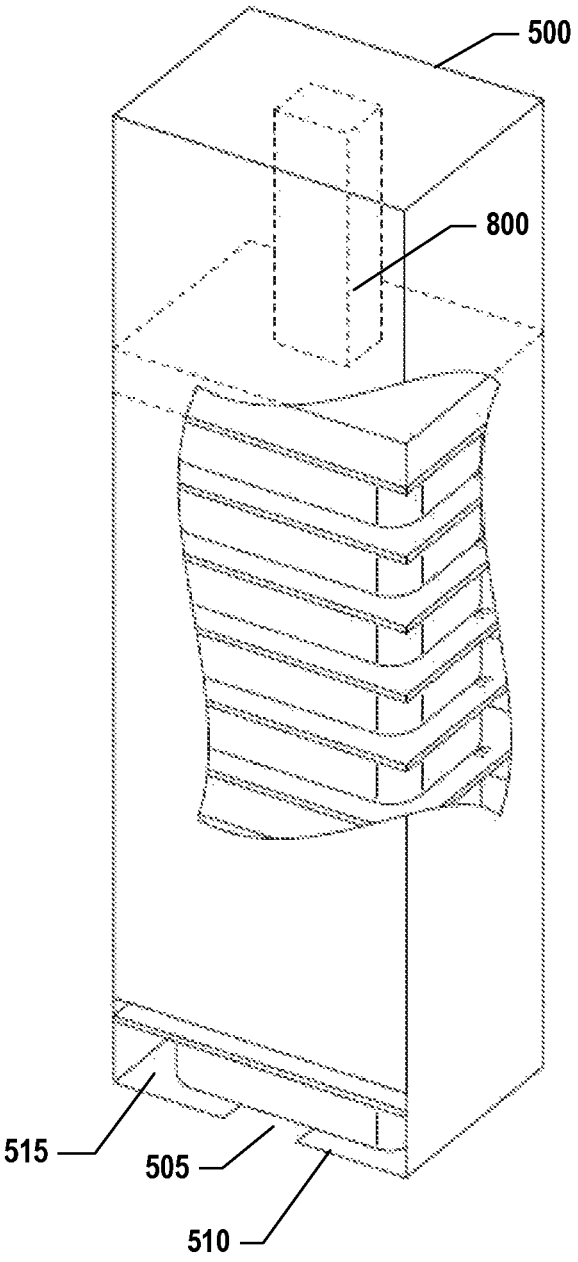

As will be recognized, the magazine 500 may be secured or attached to a frame within the dispensing unit 100 in a variety of other manners with different orientations (not shown). For example, in one embodiment, the magazine 500 can be secured or attached to a frame in a horizontal position with respect to the top and bottom of the magazine 500. In such an embodiment, as shown in FIG. 8, the top of the magazine 500 may include a spring mechanism 800 (or other biasing mechanism) to constantly urge the blister packages toward the bottom of the magazine 500. Further, in such an embodiment, the magazine 500 can be selectively moved to the left or right (or right to left) from a non-dispensing position within the dispensing unit 100 to a dispensing position (e.g., via the dispensing unit computing entity). As a blister package in contact with the sliding surface 515 of the bottom is urged out of the dispensing opening 510, the spring mechanism 800 (or other biasing mechanism) can urge the remaining blister packages toward the bottom of the magazine 500 (e.g., from left to right or right to left). After dispensing a blister package, the magazine 500 can be returned to its non-dispensing position within the dispensing unit 100.

Although not shown, in one embodiment, the magazine 500 may define a feeding opening through which blister packages can be fed into the magazine 500. The feeding opening can be sized to allow one blister package to be fed at a time into the magazine 500. In another embodiment, the top of the magazine 500 can be selectively removable to feed blister packages into the magazine 500. In yet another embodiment, the magazines 500 may be replaceable within the dispensing unit 100. Regardless, each magazine may comprise an identification code (e.g., barcode, RFID tag, or simple text including any number and combination of alphanumeric characters) that identifies the medication and dosage in the blister packages stored within the magazine 500. Thus, each time a magazine 500 is replaced or refilled, an integrated scan of the same can record the position of the magazine 500 to ensure that the correct blister packages are being dispensed. As will be recognized, a variety of other approaches and techniques can be used to adapt to various needs and circumstances.

In one embodiment, in addition to orientation, the one or more magazines 500 can be mounted to a frame in the dispensing unit 100 in a variety of configurations. For example, as shown in FIG. 9, the magazines 500 can be secured to a frame in a single row configuration for selective (e.g., individual) movement. FIG. 9 shows a row of magazines 500 with positions for each magazine: positions (1), (2), (3), and (4). In one embodiment, the dispensing unit computing entity can store the location of each magazine 500 and the corresponding contents—both inventory levels and types, sizes, quantities, and dosages of medications in the blister packages. For example, the magazine 500 in position (1) may store blister packages with 400 mg of Acetaminophen. The magazine 500 in position (2) may store blister packages with 60 mg of Oxycodone. The magazine 500 in position (3) may store blister packages with 875 mg of Amoxicillin. And the magazine 500 in position (4) may store blister packages with 80 mg Lipitor. The dispensing unit computing entity can cause selective movement of the appropriate magazines 500 from non-dispensing positions to dispensing positions so requested blister packages can be dispensed.

In the embodiment shown in FIG. 10, the magazines 500 can be secured to a frame in a grid configuration for selective (e.g., individual) movement. FIG. 10 shows a 4×4 grid configuration of magazines 500. In this example, each of positions (1,1), (1,2), (2,1), and (2,2) correspond to a distinct magazine 500. In one embodiment, the dispensing unit computing entity can store the location of each magazine 500 and the corresponding contents—both inventory levels and types, sizes, quantities, and dosages of medications in the blister packages. For example, the magazine 500 in position (1,1) may store blister packages with 400 mg of Acetaminophen. The magazine 500 in position (1,2) may store blister packages with 60 mg of Oxycodone. The magazine 500 in position (2,1) may store blister packages with 875 mg of Amoxicillin. And the magazine 500 in position (2,2) may store blister packages with 80 mg of Lipitor. In an embodiment with a grid format, the magazines 500 may be lowered in alternating TOWS.

4. Exemplary Receptacles

In one embodiment, the dispensing unit 100 may comprise one or more receptacles 900. A receptacle 900 may be a drawer, bin, bag, pouch, compartment, and/or the like. In a particular embodiment shown in FIGS. 9 and 10, a receptacle 900 may comprise a front, a back, sides, and a bottom. The interior of the front, back, sides, and bottom may define a storage cavity 905 that is sized to accept a plurality of blister packages as they are urged from magazines 500. To urge blister packages from magazines 500, the receptacle 900 may comprise one or more rake elements extending from the back rim of the receptacle 900. In one embodiment, there may be a rake element 910 for each row or column of magazines. For example, in the embodiment, of FIG. 9, the receptacle 900 may include four rake elements 910, one for each aligned magazine 500. In the embodiment of FIG. 10, the receptacle 900 may include two rake elements 910, one for each row or column of magazines 500. In another embodiment (not shown), the receptacle 900 may include multiple rows of rake elements 910.

As shown in FIGS. 9 and 10, the rake elements 910 can be sized and shaped to pass through at least a portion of a rake element path 505 of at least one magazine 500. While passing through the back of a rake element path 505 toward the front of a magazine 500, the rake element 910 can engage a blister package that is in contact 500 with the sliding surface 515 of the bottom of the magazine 500 and urge it out of the dispensing opening 510 and into the receptacle's storage cavity 905.

In one embodiment, such a receptacle 900 may be secured, attached, mounted, and similar terms used herein interchangeably to a frame within the dispensing unit 100 (not shown) for selective movement of the receptacle 900 (e.g., via the dispensing unit computing entity). This may allow the receptacle 900 to be selectively moved from a non-collecting position to carry out a collection movement. In one embodiment, the collection movement may comprise moving the receptacle 900 from the non-collecting position (e.g., in the back of one or more magazines 500) toward the front of the magazines 500 and back to the non-collecting position.

After dispensing the blister packages, the blister packages can be presented to a user. For instance, the receptacle 900 may move (e.g., via the dispensing unit computing entity) to a presenting position from which a user could access the blister packages. In another embodiment, the receptacle 900 may dump the blister packages into a drawer or other compartment (e.g., via the dispensing unit computing entity) from which a user could access the blister packages. In still another embodiment, the receptacle 900 may dump the blister packages onto a conveyor (e.g., via the dispensing unit computing entity) for presentation to a user or to a scanner then a user. In the scanner embodiment, this may include each blister package being removed in a manner such that each package lands with the upper surface 310 parallel with the conveyor belt. Then, as the conveyor transports the stripped medications to a location beyond the end of the last magazine 500, a scanner can identify the stripped medications (e.g., blister packages) before they are indexed off the end of the belt into a receptacle 900. This scanning process can also confirm that the medications requested were dispensed correctly.

As will be recognized, certain embodiments may be more manual in nature. For example, in one embodiment, the receptacle 900 may be a drawer that can be pulled forward by a user to dispense blister packages and present the same to the user. As will be recognized, a variety of other approaches and techniques can be used to adapt to various needs and circumstances.

III. Exemplary Operation of Dispensing Unit

FIG. 11 provides steps for dispensing items (e.g., blister packages) from dispensing units 100 according to one embodiment of the present invention. The process may begin at Block 1100 with the dispensing unit computing entity receiving information for items that are to be dispensed. Such information can be received in a variety of ways including via input from a user, a communication from another computing entity, and/or the like.

After receiving such information, the dispensing unit (e.g., via the dispensing unit computing entity) can move the appropriate magazines to their respective dispensing positions (Block 1105). In one embodiment, this may involve lowering the appropriate magazines 500 a configurable distance (such as three inches) to a common dispensing position. In another embodiment, this may involve lowering each magazine 500 a configurable distance that corresponds to the magazine 500. For example, a magazine 500 storing blister packages that are one inch in height, two inches in width, and four inches in length may need to be lowered four inches to be in dispensing position. Similarly, a magazine 500 storing blister packages that are that are two inches in height, four inches in width, and six inches in length may need to be lowered three inches to be in dispensing position. As will be recognized, this configurable distance (and orientation of the movement) may vary to adapt to different needs and circumstances.

In one embodiment, the dispensing unit (e.g., via the dispensing unit computing entity) can then move the receptacle 900 through its collection movement (Block 1110). The collection movement may be selectively moving the receptacle 900 from a non-collecting position in the back of one or more magazines 500 toward the front of the magazines 500. Through the collection movement, the respective rake elements 910 can pass through the rake element paths 505 of lowered magazines 500. By passing through a given rake element path 505, the rake elements 910 can engage individual blister packages in contact with sliding surfaces 515 to urge them out of the respective dispensing openings 510. In the embodiment of FIG. 9, for instance, the receptacle 900 would have four rake elements 910, with each rake elements 910 passing through a different rake element path 505. In the embodiment of FIG. 11, the receptacle 900 would have two rake elements 910 passing through two different rake element paths 505 each (provided the magazines 500 are sufficiently spaced apart), with the rake element paths 505 of the magazines 500 in positions (1,1) and (2,1) being substantially aligned and the rake element paths 505 of the magazines 500 in positions (1,2) and (2,2) being substantially aligned.

As shown in Block 1115, any lowered magazines can then be returned to their non-dispensing positions. For embodiments in which the magazines 500 in the grid configuration are not sufficiently spaced apart to allow two adjacent magazines to be lowered at the same time (e.g., magazines 500 in positions (1,1) and (2,1) or the magazines 500 in positions (1,2) and (2,2)), this can complete the first pass of dispensing blister packages. This is because in a grid format, for magazines 500 that are stored in the dispensing unit 100 are close together, the magazines 500 may be required to be moved to their dispensing positions in alternating rows. In such an embodiment, no two magazines 500 are moved to their dispensing positions at the same time if they are in adjacent positions with regard to the alignment of the rake element paths 505 as described above. For instance, in FIG. 10, the magazines 500 in positions (1,1) and (2,1) would not be moved to their dispensing positions at the same time since the blister package being ejected from the magazine 500 in position (2,1) would be urged into the back of the magazine 500 in position (1,1). Similarly, the magazines 500 in positions (1,2) and (2,2) would not be moved to their dispensing positions at the same time since the blister package being ejected from the magazine 500 in position (2,2) would be urged into the back of the magazine in position (1,2). However, regardless of the number of magazines 500 in the grid configuration, the magazines 500 can be arranged such that no more than two collection movements are required by the receptacle 900 to dispense the blister packages requested—provided no more than one blister package is required from a particular magazine 500. If more than one blister package is required from a particular magazine 500, the receptacle 900 would make the same number of collection movements to dispense the blister packages.

Continuing with the above grid configuration, after completing the first collection movement and returning the magazines 500 to their non-dispensing positions, the dispensing unit (e.g., via the dispensing unit computing entity) can determine if any other blister packages need to be dispensed (Block 1120). If so, the dispensing unit (e.g., via the dispensing unit computing entity) can move any other appropriate magazines 500 to their respective dispensing positions (Block 1105), move the receptacle 900 through its collection movement (Block 1110), and return the magazines 500 to their non-dispensing positions.

In an alternative embodiment, the receptacle 900 may have multiple rows of rake elements 910 (not shown). Thus, in a grid configuration, a single collection movement can be used by appropriately raising and lowering the magazines 500, for example, with specified timing and coordination with regard to the receptacle 900 collection movement. For instance, certain magazines 500 can be lowered to their dispensing positions and the receptacle 900 can complete part of its collection movement and stop (e.g., move forward a predetermined distance and stop). Then, the lowered magazines 500 can be returned to their non-dispensing positions and appropriate magazines 500 in alternating rows can be lowered to their dispensing positions for the receptacle 900 to complete its collection movement (e.g., complete its forward movement and return to the non-collecting position). As will be recognized, though, a variety of other approaches and techniques can also be used to adapt to various needs and circumstances.

As indicated in Block 1125, the blister packages can then be presented to a user. As described above, this may include moving the receptacle 900 (e.g., via the dispensing unit computing entity) to a presenting position from which a user could access the dispensed blister packages. It may also include the receptacle 900 dumping the blister packages into a drawer or onto a conveyor for presentation to the user. Further, the dispensing unit 100 (e.g., via the dispensing unit computing entity) can also track the inventory of blister packages that are refilled, replaced, and/or dispensed from the dispensing unit 100.

IV. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A storage apparatus for storing a pill, the storage apparatus comprising:

an upper surface defining a substantially planar flange;

a storage cavity having a first depth and an opening at the upper surface, the substantially planar flange extending outwardly from the opening of the storage cavity;

a plurality of support structures each having a second depth and an opening at the upper surface, the plurality of support structures comprising a first support structure and a second support structure, the first support structure mirroring the second support structure across a centerline of the storage apparatus; and a substantially planar backing adhered to the substantially planar flange, wherein:

the opening of the storage cavity (i) has a first opening cross-sectional area, (ii) the first opening cross-sectional area is sized to accept the pill, (iii) is covered by the substantially planar backing, such that the storage cavity, when covered, is sized to store the pill, and (iv) stores the pill, the opening of each of the plurality of support structures (i) has a second opening cross-sectional area that is smaller than the first opening cross-sectional area of the opening of the storage cavity, (ii) the second opening cross-sectional area is sized to not accept the pill, and (iii) is covered by the substantially planar backing, and the second depth of each of the plurality of support structures is greater than the first depth of the storage cavity, such that each of the plurality of support structures is configured to support the storage apparatus when resting on either a planar surface or a substantially planar backing of an adjacently positioned storage apparatus while simultaneously maintaining the storage cavity in a raised position that is not in contact with the planar surface or the substantially planar backing of the adjacently positioned storage apparatus.

2. The storage apparatus of claim 1, wherein the storage apparatus is a blister package.

3. The storage apparatus of claim 1, wherein (a) the storage cavity comprises a medication cavity and (b) each support structure has a substantially rectangular cross section.

4. The storage apparatus of claim 1, wherein each support structure extends in a direction away from the opening of the storage cavity.

5. The storage apparatus of claim 4, wherein the first support structure and the second support structure are positioned on opposite sides of the storage cavity.

6. The storage apparatus of claim 1, wherein the opening of each support structure at the upper surface of the storage apparatus comprises a substantially planar flange extending outwardly from the opening of the support structure.

7. A stack of storage apparatus, wherein each storage apparatus is for storing a pill and comprises:

an upper surface;

a storage cavity having a first depth and an opening at the upper surface, a substantially planar flange extending outwardly from the opening of the storage cavity;

a plurality of support structures each having a second depth and an opening at the upper surface, the plurality of support structures comprising a first support structure and a second support structure, the first support structure mirroring the second support structure across a centerline of the storage apparatus; and a substantially planar backing adhered to the substantially planar flange, wherein:

the opening of the storage cavity (i) has a first opening cross-sectional area, (ii) the first opening cross-sectional area is sized to accept the pill, (iii) is covered by the substantially planar backing, such that the storage cavity, when covered, is sized to store the pill, and (iv) stores the pill, the opening of each of the plurality of support structures (i) has a second opening cross-sectional area that is smaller than the first opening cross-sectional area of the opening of the storage cavity, (ii) the second opening cross-sectional area is sized to not accept the pill, and (iii) is covered by the substantially planar backing, and the second depth of each of the plurality of support structures is greater than the first depth of the storage cavity, such that each of the plurality of support structures is configured to support the storage apparatus when resting on either a planar surface or a substantially planar backing of an adjacently positioned storage apparatus while simultaneously maintaining the storage cavity in a raised position that is not in contact with the planar surface or the substantially planar backing of the adjacently positioned storage apparatus.

8. The stack of storage apparatus of claim 7, wherein for each storage apparatus, (a) the storage cavity comprises a medication cavity and (b) each support structure has a substantially rectangular cross section.

9. The stack of storage apparatus of claim 7, wherein for each storage apparatus, each support structure extends in a direction away from the opening of the storage cavity.

10. The stack of storage apparatus of claim 9, wherein for each storage apparatus, the first support structure and the second support structure are positioned on opposite sides of the storage cavity.

11. The stack of storage apparatus of claim 7, wherein stack of storage apparatus are stored in a magazine.

12. The stack of storage apparatus of claim 7, wherein for each storage apparatus, the substantially planar flange extending outwardly from each support structure is substantially parallel to the upper surface of each other storage apparatus.

* * * * *